US006775916B2

(12) United States Patent
Sparkes

(10) Patent No.: US 6,775,916 B2
(45) Date of Patent: Aug. 17, 2004

(54) FRAMER'S LAYOUT SQUARE

(76) Inventor: David C. Sparkes, 309 Old Farm School Rd., Asheville, NC (US) 28805

( * ) Notice: Subject to any disclaimer, the term of this patent is extended or adjusted under 35 U.S.C. 154(b) by 319 days.

(21) Appl. No.: 09/860,111

(22) Filed: May 17, 2001

(65) Prior Publication Data

US 2003/0145475 A1 Aug. 7, 2003

(51) Int. Cl.[7] ..... G01D 21/00
(52) U.S. Cl. ..... 33/613; 33/494
(58) Field of Search ..... 33/613, 645, 562, 33/758, 759, 494, 42, 429, 474, 476

(56) References Cited

U.S. PATENT DOCUMENTS

| | | | | |
|---|---|---|---|---|
| 1,665,400 A | | 4/1928 | Bittner | 33/501 |
| 2,466,919 A | | 4/1949 | Sykes | |
| 2,563,674 A | | 8/1951 | Coots | |
| 2,579,664 A | | 12/1951 | Gleasman | |
| 2,659,980 A | | 11/1953 | Dunn | 33/563 |
| 3,169,320 A | | 2/1965 | Currie | 33/613 |
| 3,834,033 A | | 9/1974 | Pinkard | |
| 4,212,108 A | | 7/1980 | Jackson | 33/645 |
| 4,301,596 A | * | 11/1981 | Sedlock | 33/494 |
| 4,499,666 A | | 2/1985 | Smith | 33/562 |
| 4,527,337 A | | 7/1985 | Dreiling | |
| 4,573,276 A | | 3/1986 | Torczon | |
| 4,574,492 A | | 3/1986 | Miller | |
| 4,607,438 A | | 8/1986 | DeFrange | |
| 5,083,380 A | | 1/1992 | Robertson | |
| 5,140,755 A | | 8/1992 | Simmons, Jr. | |
| 5,367,783 A | | 11/1994 | Nygren | 33/613 |
| 5,396,710 A | | 3/1995 | Battaglia | |
| 5,456,015 A | | 10/1995 | Butcher et al. | |
| 5,509,207 A | | 4/1996 | Harms | |
| 5,768,795 A | | 6/1998 | Jimenez | |
| 5,960,554 A | | 10/1999 | Kamykowski | |

OTHER PUBLICATIONS

"House Framing" by John D. Wagner, Publisher: Creative Homeowner. pp. 91–110 (1998).
"Residential Framing 13 A Homebuilders's Construction Guide" by William P. Spence, Sterling Publishing Company. pp. 119–142.

* cited by examiner

*Primary Examiner*—Christopher W. Fulton
(74) *Attorney, Agent, or Firm*—Carter Schnedler & Monteith, P.A.

(57) ABSTRACT

A layout tool for laying out or "marking" positions at a predetermined spacing for the attachment of studs having a nominal thickness to a length of dimensioned lumber comprising a plate, when framing walls during construction of a building. The layout tool includes an elongated rail for placement against the plate, and a first stud marking guide extending perpendicularly from the elongated rail. The first stud marking guide has left and right side edges, and width between the side edges corresponding to the nominal thickness of the studs. A separate stud marking guide extends perpendicularly from the elongated rail. The second stud marking guide likewise has left and right side edges and a width between the side edges corresponding to the nominal thickness of the studs. The left edge of the second stud marking guide is spaced from the left edge of the first stud marking guide a distance equal to the predetermined stud spacing. A primary starter marking indication is provided on the elongated rail intermediate the first and second stud marking guides. The primary starter marking indication is spaced from the second stud marking guide a distance equal to one-half the nominal thickness of the studs.

11 Claims, 8 Drawing Sheets

50
60
62
64
66
68
70
72
74
76
84
86
200
202
204
206
208
210
212
214
216
218
220
222
224
226
228
230
232
16"
11¾"
12½"

FRAMER'S LAYOUT SQUARE

BACKGROUND OF THE INVENTION

The invention relates to tools for laying out or "marking" the positions of wall studs on top and bottom plates during framing.

In framing walls during construction of a building, frame wall assemblies generally are laid out on the floor of the building structure, cut to size, and at least partially assembled before the wall is raised. Wall framing is made of dimensioned lumber, typically either 2×4 or 2×6. Walls have a bottom plate in the form of a length of dimensioned lumber, a top plate (single or double) in the form of one or two lengths of dimensioned lumber, and a plurality of vertical studs. Typically, studs are spaced on 16-inch centers, although 24-inch center-to-center spacing is used in some cases. By convention, the actual dimensions of so-called 2×4 lumber are 1½ inches×3½ inches. The actual dimensions of so-called 2×6 lumber are 1½ inches×5½ inches. Thus, in either case, the nominal thickness is 1½ inches.

Typically, a framing square and a measuring device (which may be part of the framing square) are employed to locate and mark the positions of studs on the top and bottom plates. In conventional practice, the top and bottom plates are laid next to each other on the floor, either turned on edge for box framing, or laid flat for stick framing. In either event, the position of an end stud is marked at one end of the plates, by means of a perpendicular line spaced 1½ inches from the end of the top and bottom plates, and typically marked with an "X" between the end of the plates and the perpendicular line to indicate the position of an end stud.

Although the studs in general are on 16-inch centers, the first intermediate stud is not positioned with its center 16 inches from the center of the end stud. Rather, so that the edge of standard 4×8 foot sheathing material falls on the centerline of a stud, the first intermediate stud is located such that its centerline is 16 inches from the end of the top and bottom plates. Stated alternatively, since one-half the nominal 1½ inch nominal thickness of the studs is ¾ inch, the edge of the first intermediate stud is located 15¼ inches from the end of the plates.

SUMMARY OF THE INVENTION

In an exemplary embodiment, a layout tool is provided for laying out positions at a predetermined spacing for the attachment of studs having a nominal thickness to a length of dimensioned lumber comprising a plate. The layout tool includes an elongated rail for placement against the plate, and a first stud marking guide extending perpendicularly from the elongated rail. The first stud marking guide has left and right side edges, and width between the side edges corresponding to the nominal thickness of the studs. The layout tool includes a separate stud marking guide extending perpendicularly from the elongated rail. The second stud marking guide likewise has left and right side edges and a width between the side edges corresponding to the nominal thickness of the studs. The left edge of the second stud marking guide is spaced from the left edge of the first stud marking guide a distance equal to the predetermined stud spacing. There is a primary starter marking indication on the elongated rail intermediate the first and second stud marking guides. The primary starter marking indication is spaced from the second stud marking guide a distance equal to one-half the nominal thickness of the studs.

DETAILED DESCRIPTION

Figure 1:
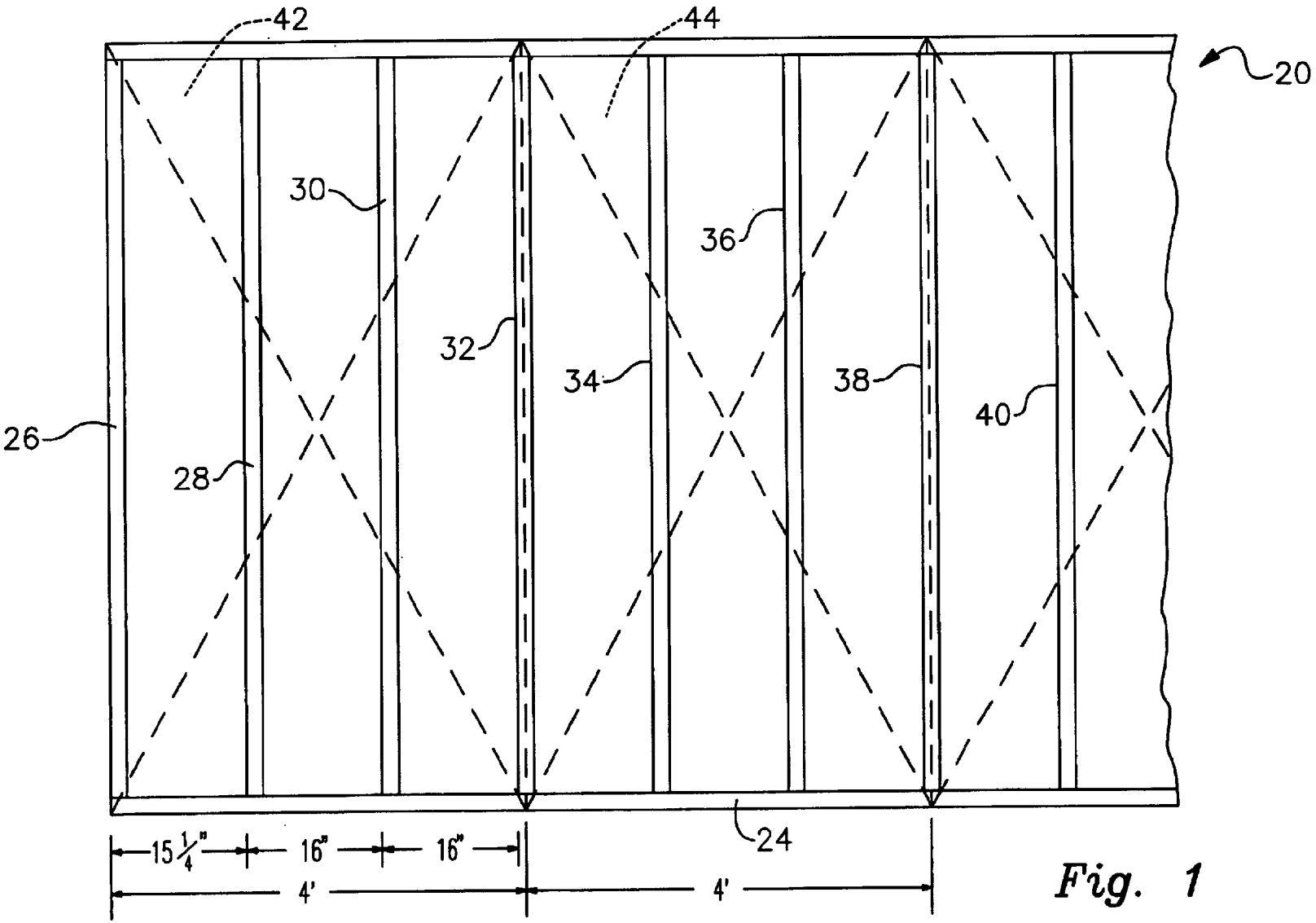
FIG. 1 is a front elevational representation of a framed wall, with 4×8 foot sheathing applied.

FIG. 1 depicts a framed wall, generally designated 20, of conventional construction. The framed wall 20 is an exterior wall constructed of either 2×4 inch or 2×6 inch dimensioned lumber, with a stud spacing of 16 inches. Thus, the wall 20 includes a top plate 22 and a bottom plate 24 each made of a length of dimensioned lumber, and a plurality of studs extending vertically therebetween. More particularly, beginning at the left side of the wall 20 is an end stud 26, followed by a first intermediate stud 28, and a plurality of subsequent intermediate studs 30, 32, 34, 36, 38 and 40. The framing is covered by representative 4×8 foot sheathing panels 42 and 44.

As is well known, the studs 28, 30 and 32 are placed such that the edge of the 4×8 foot sheathing material falls on the center line of a stud. Thus, for 16-inch center to-center framing, the first intermediate stud 28 is placed 15¼ inches from the left ends of the top and bottom plates 22 and 24. This 15¼ inch spacing is calculated by subtracting ¾ inch, which is one-half the 1½ inch nominal stud thickness, from 16 inches, which is the stud spacing. If 24-inch center-to-center stud spacing were being employed, then the first intermediate stud 28 would be placed 23¼ inches from the ends of the top and bottom plates 22 and 24.

During sheathing, the left edge of the sheathing panel 42 is aligned evenly with the left ends of the top and bottom plates 22 and 24, and with the left side of the end stud 26. The right side of the sheathing panel 42 then falls on the centerline of the subsequent intermediate stud 32. The sheathing panel 42 is nailed or otherwise fastened to the studs 26, 28, 30 and 32. The next sheathing panel 44 is then placed adjacent the sheathing panel 42, and extends between the midpoint of the subsequent intermediate stud 32 and the subsequent intermediate stud 38.

Figure 2:
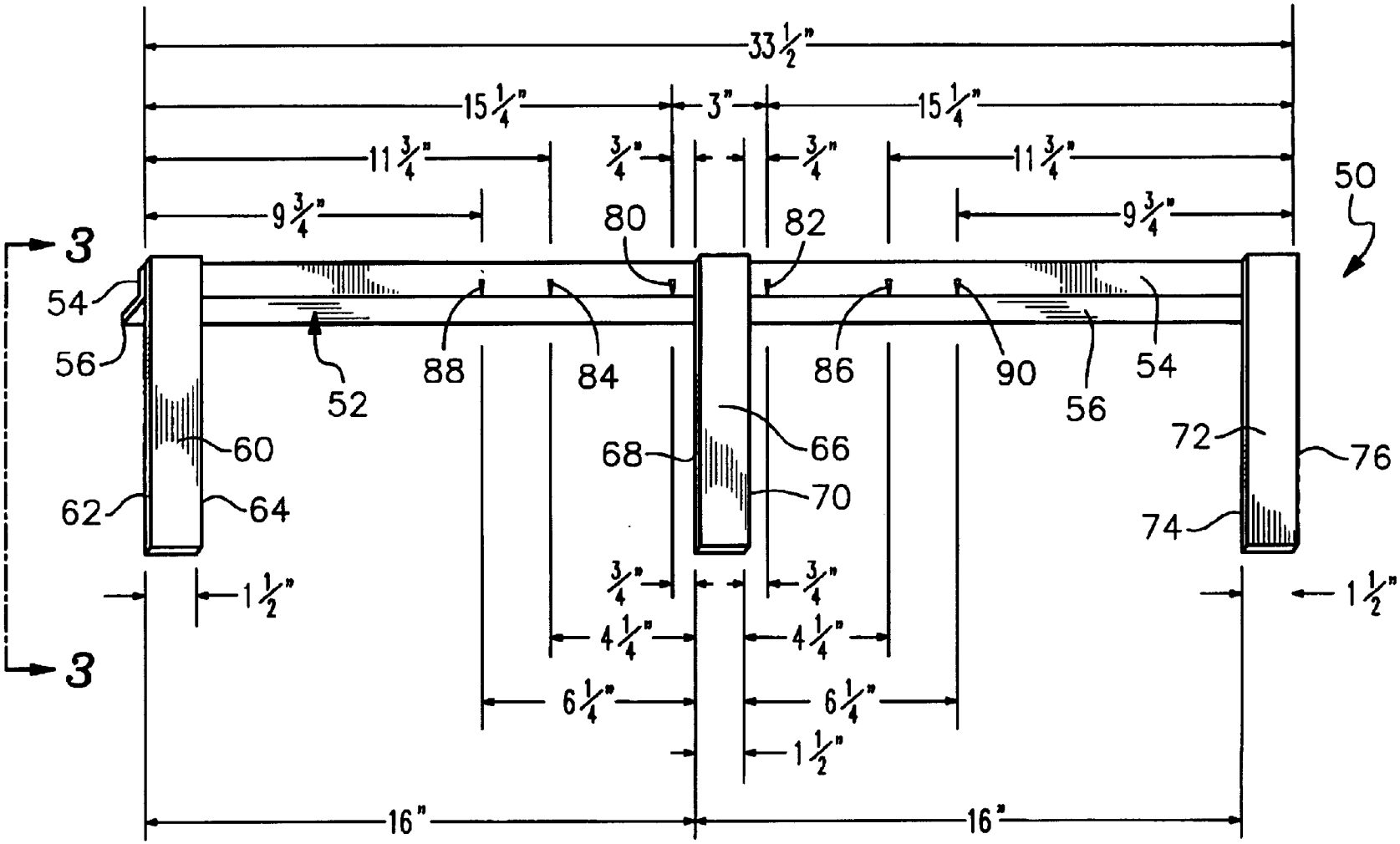
FIG. 2 is a three dimensional view of a layout tool embodying the invention.
Figure 3:
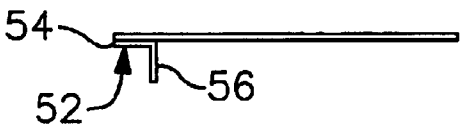
FIG. 3 is a side elevational view taken on line 3—3 of FIG. 2.

With reference now to the three dimensional view of FIG. 2 and the side elevational view of FIG. 3, a layout tool 50 embodying the invention includes an elongated rail 52 for placement against either a top or bottom plate, such as the FIG. 1 top and bottom plates 22 and 24, during marking. In the exemplary embodiment, the elongated rail 52 is "L" shaped in cross section, and has two legs 54 and 56 at right angles. In the exemplary embodiment, the thickness of the legs 54 and 56 is 3/16 inch. To ensure proper orientation for perpendicular marking, during use the side of the leg 56 engages in the surface of the plates.

The illustrated layout tool 50 is for laying out the positions for the attachment of studs at a predetermined spacing of 16 inches, center-to-center, and the overall length of the elongated rail 52 and thus of the tool 50 is 33½ inches. Other layout tools embodying the invention may be made for use during the construction of walls having 24-inch center-to-center stud spacing. The layout tool 50 is made of aluminum.

Extending perpendicularly from the elongated rail 52, at the left end thereof, is a first stud marking guide 60. The first stud marking guide 60 may be attached to the elongated rail 52 by welding, or may be integrally formed with the elongated rail 52, depending upon the manner of fabrication. The first stud marking guide 60 has left and right side edges 62 and 64, and a width between the left and right side edges 62 and 64 of 1½ inches, corresponding to the nominal thickness of the studs.

In the illustrated embodiment, the thickness of the first stud marking guide 60 is 3/16 inch. The first stud marking guide 60 may be of any convenient length, such as 7½ inches from the elongated rail 52, for simultaneously marking a top and bottom plate made of 2×4 inch lumber, laid flat side-by-side for stick framing. If the layout tool 50 were to be used only for box framing, where the plates are turned on edge for marking, the first stud marking guide 60 could be shorter.

Also extending perpendicularly from the elongated rail 52 is a second stud marking guide 66. The second stud marking guide 66 likewise has left and right side edges 68 and 70, and a width between the left and right side edges 68 and 70 of 1½ inches, corresponding to the nominal thickness of the studs. The left edge 68 of the second stud marking guide 66 is spaced from the left side edge 52 of the first stud marking guide 60 a distance of 16 inches, corresponding to the predetermined stud spacing.

Extending perpendicularly from the elongated rail 52 at the right end thereof is a third stud marking guide 72, likewise having left and right side edges 74 and 76. The left and right side edges 74 and 76 again are spaced from each other a distance of 1½ inches, corresponding to the predetermined stud spacing. Thus, the layout tool 50 is symmetrical about a longitudinal midplane perpendicular to a longitudinal axis, and can be used to lay out stud positions starting either from the left side of the wall as depicted in FIG. 1, or from the right side.

Engraved or otherwise marked on the elongated rail 52 intermediate the first and second stud marking guides 60 and 66 is a primary starter marking indication 80. In the exemplary embodiment, the primary starter marking indication 80 takes the form of a pencil guide groove formed in the angle stock leg 54, and terminating at the corner edge where the legs 54 and 56 join. The groove has an elongated "V" configuration, ½ inch in length, and tapers in width from approximately 3/16 inch to approximately 1/32 inch at the corner edge. During use, a pencil point engages the groove at an intermediate point, facilitated by the relatively wider width near the 3/16 inch end. The pencil point is moved towards the 1/32 inch end, and emerges from the groove at the corner edge where the legs 54 and 56 join, to make a precisely-located starting mark on a top or bottom plate as described hereinbelow with reference to FIGS. 4, 8 and 12.

The primary starter marking indication 80 is spaced from the second stud marking guide 66, more particularly from the left side edge 68 thereof, a distance of ¾ inch, which is equal to one-half the nominal thickness of the studs. For the layout tool 50 intended for use in laying out studs on 16-inch centers, the primary starter marking indication 80 is 15¼ inches from the left end of the elongated rail 52. For a layout tool intended for use in laying out studs on 24-inch centers (not shown), the primary starting marking indication would be 23¼ inches from the left end of the elongated rail.

As noted above, the layout tool 50 is symmetrical about a longitudinal midplane perpendicular to a longitudinal axis. Accordingly, there is an opposite-side primary starter marking indication 82 on the elongated rail 52 intermediate the second stud marking guide 66 and the third stud marking guide 52. The opposite-side primary starter marking indication 82 is spaced from the second stud marking guide 66, more particularly from the right side edge 70 thereof, a distance of ¾ inch, which, again, is equal to one-half the nominal thickness of the studs. In the exemplary embodiment, the opposite-side primary starter marking indication 82 takes the form of a pencil guide groove identical in configuration to the primary starter marking indication 80.

As thus far described, the layout tool 50 is useful in laying out the positions of studs when framing exposed end walls. However, when laying out the positions of studs for a butted-end wall, the thickness of an adjacent wall to be butted against must be taken into account when marking the position of the first intermediate stud.

For framing with 2×4 inch lumber, the layout tool 50 includes a first butted wall starter marking indication 84 on the elongated rail 52 intermediate the first stud marking guide 60 and the primary starter marking indication 80. In the exemplary embodiment, the first butted wall starter marking indication 84 also takes the form of a pencil guide groove identical in configuration to the primary starter marking indication 80. The first butted wall starter marking indication 84 is spaced from the second stud marking guide 66, more particularly from the left side edge 68 thereof, a distance of 4¼ inches, which is equal to the sum of ¾ inches (one-half the nominal 1½ inch thickness of the studs) and the nominal 3½ inch thickness of an adjacent wall to be butted. For the layout tool 50 intended for use in laying out studs on 16-inch centers, the first butted wall starter marking indication 84 is 11¾ inches from the left end of the elongated rail 52.

Again as noted above, the layout tool 50 is symmetrical about a longitudinal midplane perpendicular to a longitudinal axis. Accordingly, on the elongated rail 52, intermediate the third stud marking guide 72 and the opposite-side primary starter marking indication 82 is an opposite-side first butted wall starting marking indication 86, which likewise takes the form of a pencil guide groove identical in configuration to the primary starter marking indication 80. The opposite side first butted wall starter marking indication 86 is spaced from the second stud marking guide 66, more particularly from the right side edge 70 thereof, a distance of 4¼ inches. This distance is equal to one-half the nominal thickness of the studs, plus the thickness of the adjacent wall to be butted.

Finally, for laying out the positions of 2×6 inch studs on a butted wall butted against an adjacent wall of nominal 5½ inch thickness, the layout tool 50 includes a second butted wall starter marking indication 88 on the elongated rail 52 intermediate the first stud marking guide 60 and the primary starter marking indication 80. The second butted wall starter marking indication 88 takes the form of a pencil guide groove identical in configuration to the primary starter marking indication 80, and is spaced from the second stud marking guide 66, more particularly from the left side edge 68 thereof, a distance of 6¼ inches, which is equal to the sum of ¾ inches (one-half the nominal 1½ inch thickness of the studs) and the nominal 5½ inch thickness of an adjacent wall to be butted.

Again as noted above, the layout tool 50 is symmetrical about a longitudinal midplane perpendicular to a longitudinal axis. Accordingly, on the elongated rail 52, intermediate the third stud marking guide 72 and the opposite-side primary starter marking indication 82 is an opposite-side second butted wall starting marking indication 90, which likewise takes the form of a pencil, guide groove identical in configuration to the primary starter marking indication 80. The opposite side second butted wall starter marking indication 90 is spaced from the second stud marking guide 66, more particularly from the right side edge 70 thereof, a distance of 6¼ inches. This distance is equal to one-half the nominal thickness of the studs, plus the thickness of the adjacent wall to be butted.

FIGS. 4–7 depict use of the layout tool 50 in laying out the positions of studs on representative top and bottom plates 100 and 102. In FIGS. 4–7, 2×4 inch plates are laid flat for stick framing, but could as well be placed on edge for box framing. Since FIGS. 4–7 illustrate the stud marking for an exposed end wall, rather than a butted-end wall, these figures apply to either 2×4 or 2×6 inch framing.

Figure 4:
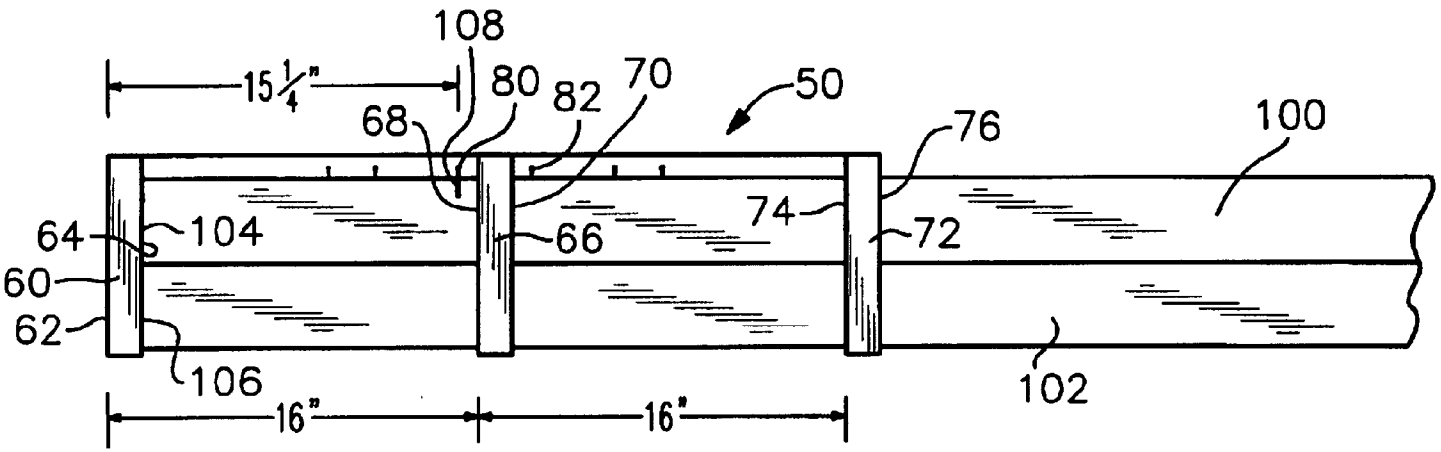
FIG. 4 depicts an initial step during use of the layout tool to mark the top and bottom plates of a framed exposed end wall, constructed of either 2×4 inch or 2×6 inch lumber to indicate stud locations.

In FIG. 4, the layout tool 50 is placed on the top and bottom plates 100 and 102, with the left side edge 62 of the first stud marking guide 60 aligned evenly with the left ends of the top and bottom plates 100 and 102. To ensure "square" placement, the leg 56 (FIGS. 2 and 3) of the angle stock is held firmly against an edge of the plate 100.

Using the right side edge 64 of the first stud marking guide 60 as a guide, a line having two stud position indicating line segments 104 and 106 is drawn across the top and bottom plates 100 and 102, spaced from the left ends of the plates 100 and 102 a distance of 1½ inches, the nominal thickness of the studs, and also the width of the first stud marking guide 60. Then, employing the primary starter marking indication 80, a starting mark 108 is made on one of the plates 100 and 102. For reasons discussed hereinabove, the starting mark 108 is 15¼ inches from the left ends of the top and bottom plates 100 and 102.

Figure 5:
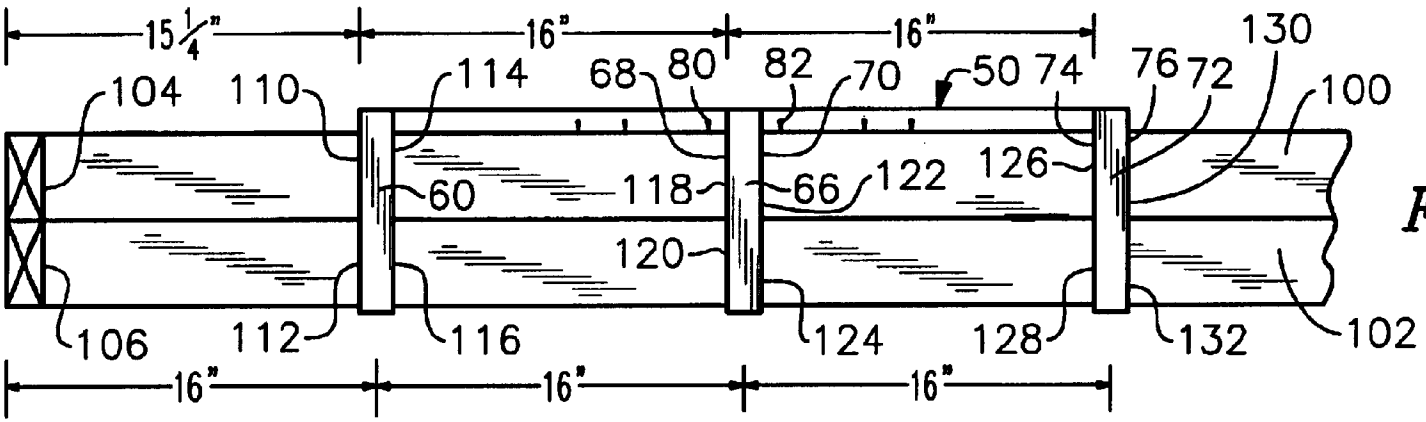
FIG. 5 depicts a subsequent step during use.

Referring next to FIG. 5, the layout tool 50 is advanced to the right, such that the left side edge 62 of the first stud marking guide 60 is aligned with the starting mark 108. "X" marks are drawn on the plates 100 and 102 adjacent the stud position indicating line segments 104 and 106 to represent the position of the end stud, such as the FIG. 1 end stud 26.

Still referring to FIG. 5, the first, second and third stud marking guides 60, 66 and 72 are then used to mark the plates 100 and 102 to indicate the positions of the first intermediate stud (such as the first intermediate stud 28 of FIG. 1), as well as subsequent intermediate studs (such as the subsequent intermediate studs 30 and 32 of FIG. 1). Thus, the left side edge 62 of the first stud marking guide 60 is employed to draw stud position indicating line segments 110 and 112, and the right side edge 64 of the first stud marking guide 60 is employed as guide for drawing stud position indicating line segments 114 and 116. The left side edge 68 of the second stud marking guide 66 is employed as a guide for drawing stud position indicating line segments 118 and 120, and the right side edge 70 of the second stud marking guide 66 is employed as a guide for drawing stud position indicating line segments 122 and 124. Finally, the left side edge 74 of the third stud marking guide 72 is employed as a guide for drawing stud position indicating line segments 126 and 128, and the right side edge 76 of the third stud marking guide 72 is employed as a guide for drawing stud position indicating line segments 130 and 132. Stud positions are thus marked on the plates 100 and 102 for 16-inch center-to-center spacing.

Figure 6:
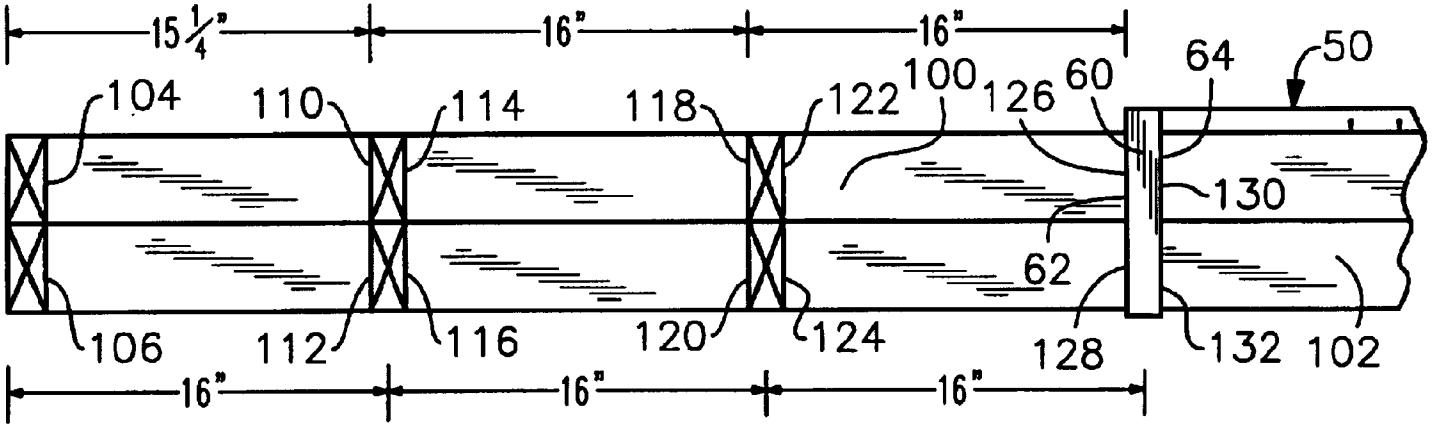
FIG. 6 depicts a further subsequent step during use.

Referring next to FIG. 6, the layout tool 50 is advanced further to the right, and "X" marks are drawn between the stud position indicating line segments 110, 114; 112, 116; 118, 122; 120, 124 to represent the positions of studs. Although not visible in FIG. 6, "X" markings may also be drawn at this stage between the stud position indicating line segments 126, 120 and 128, 132.

In any event, as represented in FIG. 6, the process continues in the same manner as described above with reference to FIG. 5, along the entire lengths of the plates 100 and 102, marking the locations of studs on 16-inch center-to-center spacing.

Figure 7:
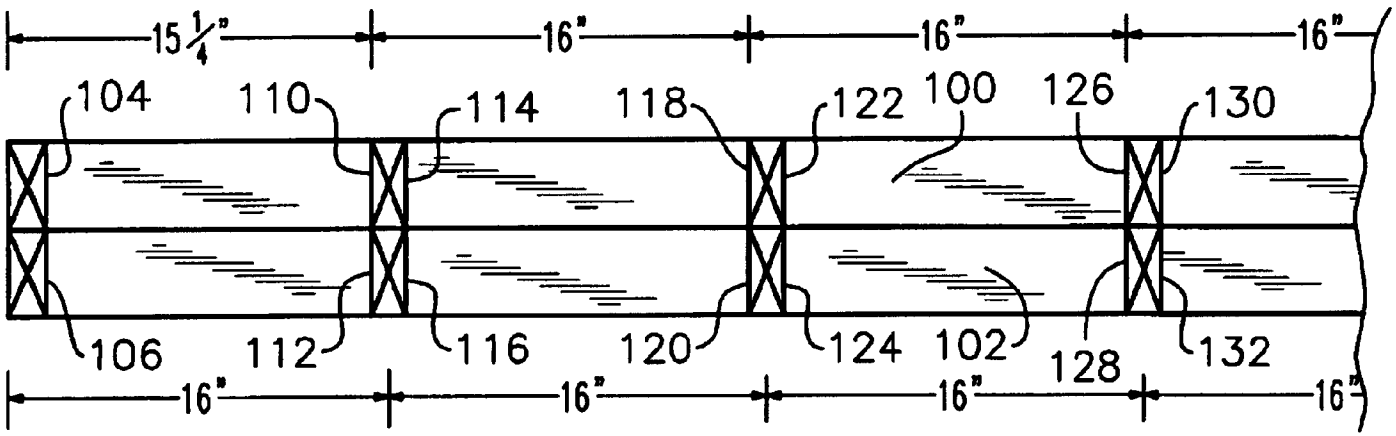
FIG. 7 depicts the final result with the top and bottom plates marked to show stud locations.

FIG. 7 represents the result. Positions are marked for studs on a 16-inch center-to-center spacing, but with the first intermediate stud spaced 15¼ inches from the end so that the edge of standard 4×8 foot sheathing material falls on the centerline of a stud.

In view of the symmetrical nature of the layout tool 50, the process described hereinabove with reference to FIGS. 4–7 can begin from the right side of the top and bottom plates 100 and 102, employing the opposite side primary starter marking indication 82 as a guide for a starting mark (not shown).

Although the layout tool 50 illustrated has three stud marking guides 60, 66 and 72, in other embodiments of the invention (not illustrated) only two stud marking guides are employed. The illustrated embodiment, with three stud marking guides, enables layout to proceed more rapidly, and is a particularly convenient configuration. It will be further appreciated that the layout tool 50 may also be extended to a tool having four or more stud marking guides, positioned 16 inches left edge to left edge.

FIGS. 8–11 depict use of the layout tool in laying out the positions of studs on representative top and bottom plates 200 and 202 of a butted-end wall. In FIGS. 8–11, 2×4 inch plates are marked for a wall to be butted against another wall made of 2×4 inch lumber, having a nominal thickness of 3½ inches.

Figures 8, 9, 10:
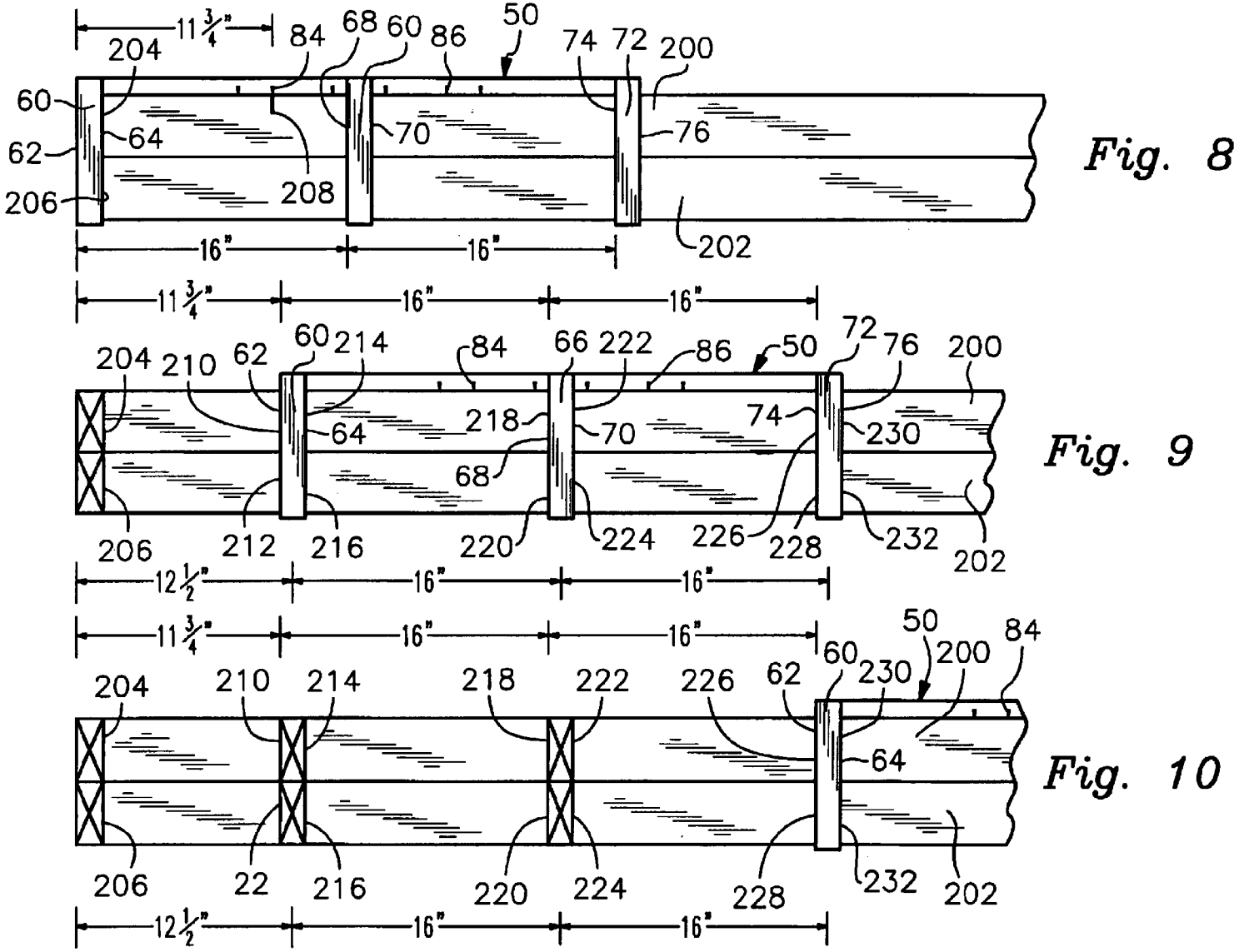
FIG. 8 depicts an initial step during use of the layout tool to mark the top and bottom plates of a framed wall, constructed of 2×4 inch lumber, to be butted against another framed wall constructed by 2×4 inch lumber to indicate stud locations.
FIG. 9 depicts a subsequent step during use.
FIG. 10 depicts a further subsequent step during use.

In FIG. 8, the layout tool 50 is placed on the top and bottom plates 200 and 202, with the left side edge 62 of the first stud marking guide 60 aligned evenly with the left ends of the top and bottom plates 200 and 202. To ensure "square" placement, the leg 56 (FIGS. 2 and 3) of the angle stock is held firmly against an edge of the plate 200.

Using the right side edge 64 of the first stud marking guide 60 as a guide, a line having two stud position indicating line segments 204 and 206 is drawn across the top and bottom plates 200 and 202, spaced from the left ends of the plates 200 and 202 a distance of 1½ inches, the nominal thickness of the studs, and also the width of the first stud marking guide 60. Then employing the first butted wall starter marking indication 84 as a guide, a starting mark 208 is made on one of the plates 200 and 202. The starting mark 208 is 11¾ inches from the left ends of the top and bottom plates 200 and 202, since the first butted wall starter marking indication 84 is 4¼ inches from the second stud marking guide 66 (the sum of one-half the nominal 1½ inch thickness of the studs and the nominal 3½ inch thickness of the adjacent wall to be butted), and the studs are on 16-inch centers. (11¾ inches+4¼ inches=16 inches).

Referring next to FIG. 9, the layout tool 50 is advanced to the right, such that the left side edge 62 of the first stud marking guide 60 is aligned with the starting mark 208. "X" marks are drawn on the plates 100 and 102 adjacent the stud position indicating line segments 104 and 106 to represent the position of the end stud, such as the FIG. 1 end stud 26.

Still referring to FIG. 9, the first, second and third stud marking guides 60, 66 and 72 are then used to mark the plates 200 and 202 to indicate the positions of the first intermediate stud, as well as subsequent intermediate studs. Thus, the left side edge 62 of the first stud marking guide 60 is employed to draw stud position indicating line segments 210 and 212, and the right side edge 64 of the first stud marking guide 60 is employed as guide for drawing stud position indicating line segments 214 and 216. The left side edge 68 of the second stud marking guide 66 is employed as a guide for drawing stud position indicating line segments 218 and 220, and the right side edge 70 of the second stud marking guide 66 is employed as a guide for drawing stud position indicating line segments 222 and 224. Finally, the left side edge 74 of the third stud marking guide 72 is employed as a guide for drawing stud position indicating line segments 226 and 228, and the right side edge 76 of the third stud marking guide 72 is employed as a guide for drawing stud position indicating line segments 230 and 232. Stud positions are thus marked on the plates 200 and 202 for 16-inch center-to-center spacing.

Referring next to FIG. 10, the layout tool 50 is advanced further to the right, and "X" marks are drawn between the stud position indicating line segments 210, 214; 212, 216; 218, 222; 220, 224 to represent the positions of studs. Although not visible in FIG. 10, "X" markings may also be drawn at this stage between the stud position indicating line segments 226, 220 and 228, 232.

In any event, as represented in FIG. 10, the process continues in the same manner as described above with reference to FIG. 9, along the entire lengths of the plates 100 and 102, marking the locations of studs on 16-inch center-to-center spacing.

Figure 11:
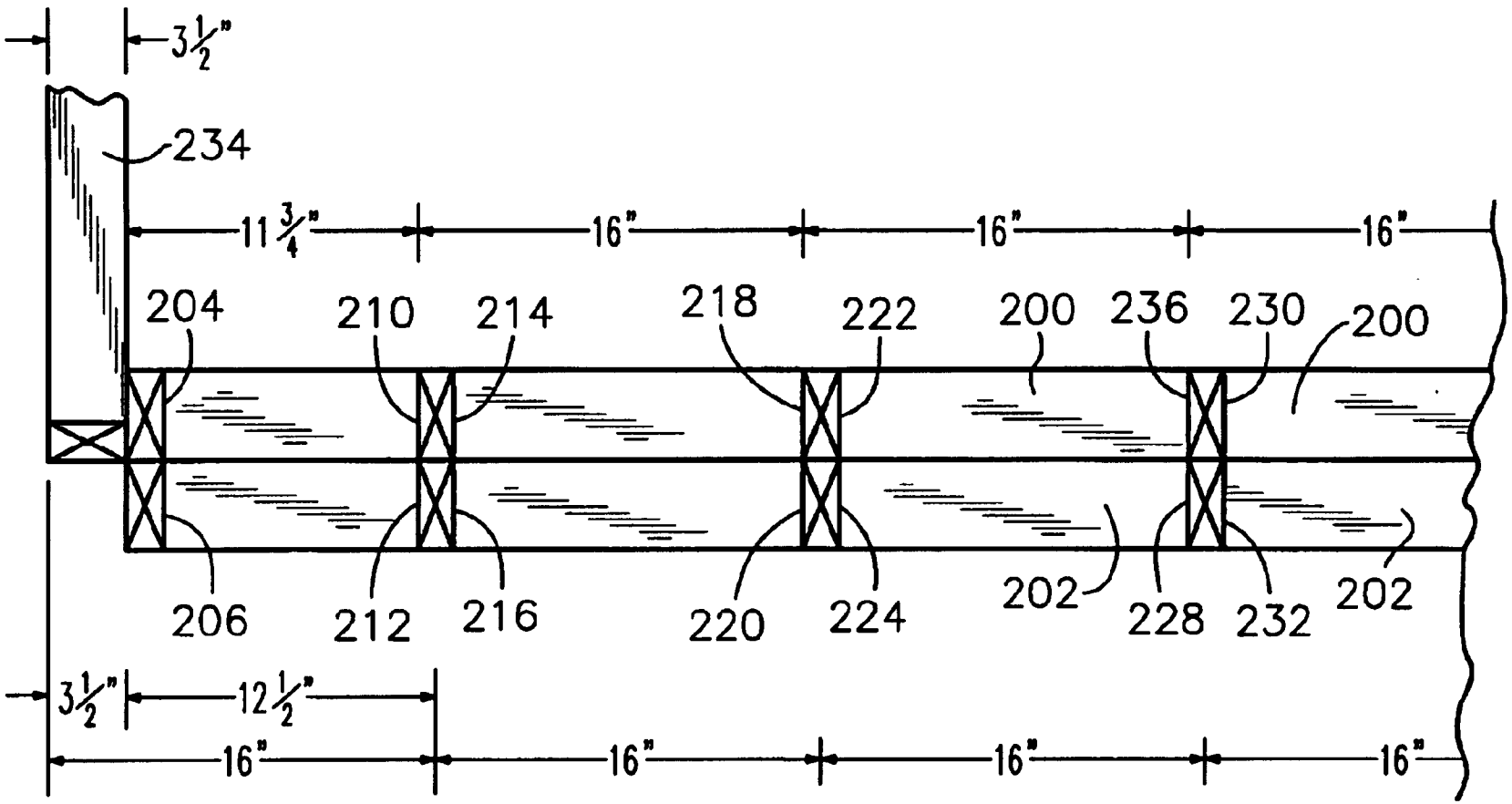
FIG. 11 depicts the final result with the top and bottom plates marked to show stud locations.

FIG. 11 represents the result, and also includes a plate 234 of an adjacent wall against which the wall being laid out is butted. The plate 234 is made of 2×4 inch lumber, and thus has a nominal thickness of 3½ inches. Positions are marked for studs on a 16-inch center-to-center spacing, but with the first intermediate stud spaced 11¾ inches from the end so that the edge of standard 4×8 foot sheathing material falls on the centerline of a stud.

In view of the symmetrical nature of the layout tool 50, the process described hereinabove with reference to FIGS. 8–11 can begin from the right side of the top and bottom plates 200 and 202, employing the opposite side first butted wall starter marking indication 86 as a guide for a starting mark (not shown).

Finally FIGS. 12–15 depict use of the layout tool 50 in laying out the positions of studs on representative plate 300 of a butted-end wall. In FIGS. 12–15, a 2×6 inch plate 300 is marked for a wall to be butted against another wall made of 2×6 inch lumber, having a nominal thickness of 5½ inches.

Figure 12:
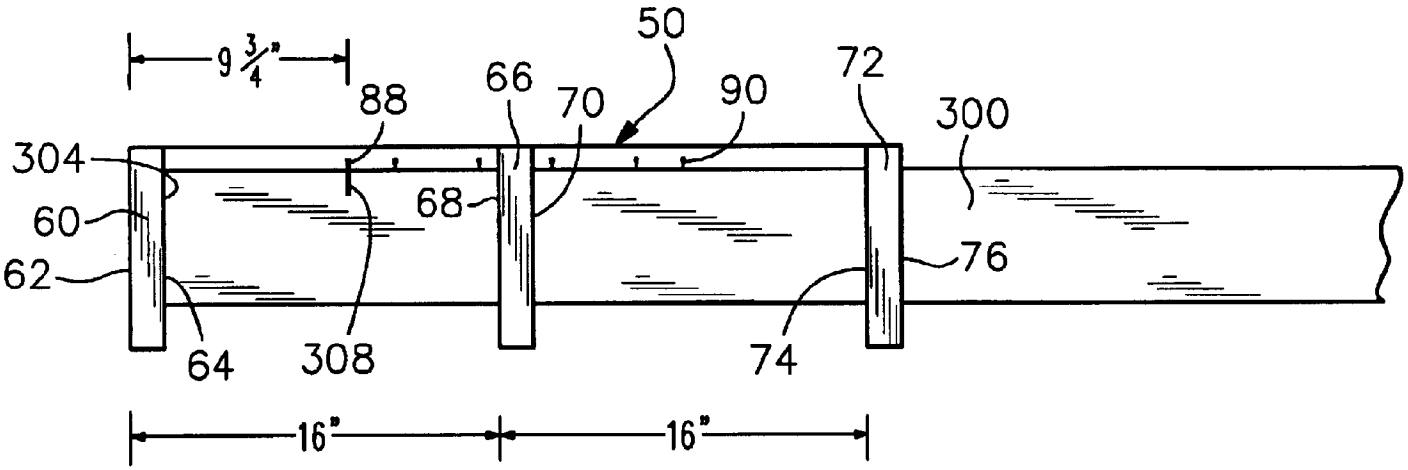
FIG. 12 depicts an initial step during use of the invention to mark either a top or a bottom plate (stick framing) of a framed wall constructed of 2×6 inch lumber, to be butted against another framed wall constructed of 2×6 inch lumber to indicate stud locations.

In FIG. 12, the layout tool 50 is placed on the plate 300, with the left side edge 62 of the first stud marking guide 60 aligned evenly with the left end of the plate 300. To ensure "square" placement, the leg 56 (FIGS. 2 and 3) of the angle stock is held firmly against an edge of the plate 300.

Using the right side edge 64 of the first stud marking guide 60 as a guide, a stud position indicating line 304 is drawn across the plate 300 spaced from the left end of the plate 300 a distance of 1½ inches, the nominal thickness of the studs, and also the width of the second stud marking guide 60. Then employing the first butted wall starter marking indication 88 as a guide, a starting mark 308 is made on the plate 200. The starting mark 308 is 9¾ inches from the left end of the plate 300, since the second butted wall starter marking indication 88 is 6¼ inches from the second stud marking guide 66 (the sum of one-half the nominal 1½ inch thickness of the studs and the nominal 5½ inch thickness of the adjacent wall to be butted), and the studs are on 16-inch centers. (9¾ inches+6¼ inches=16 inches).

Figure 13:
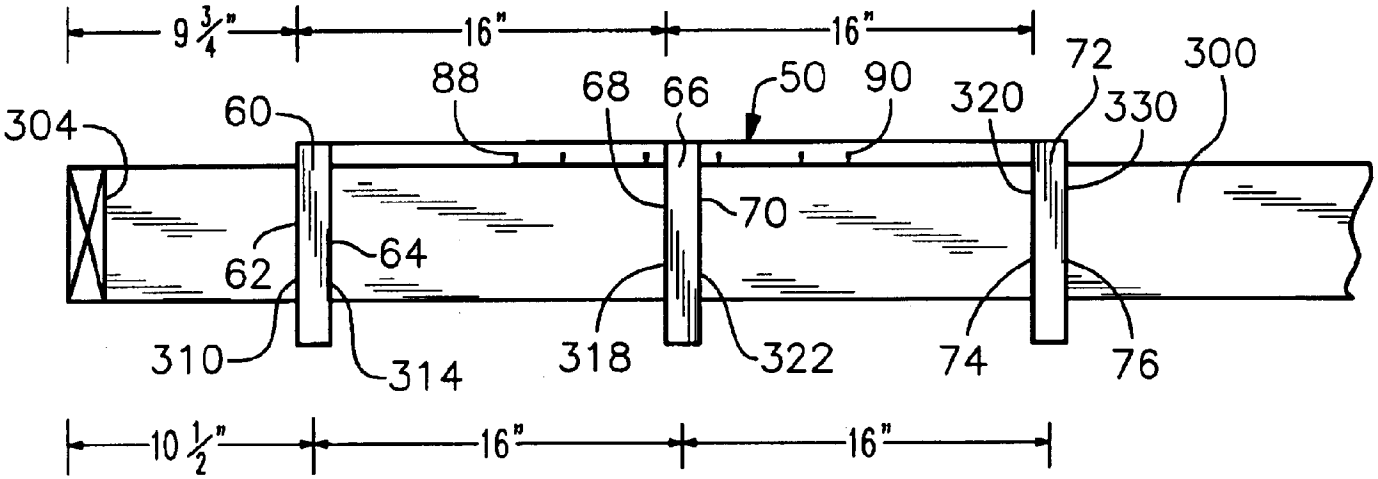
FIG. 13 depicts a subsequent step during use.

Referring next to FIG. 13, the layout tool 50 is advanced to the right, such that the left side edge 62 of the first stud marking guide 60 is aligned with the starting mark 308. "X" marks are drawn on the plate 300 adjacent the stud position indicating line 304 to represent the position of the end stud.

Still referring to FIG. 13, the first, second and third stud marking guides 60, 66 and 72 are then used to mark the plate 300 to indicate the positions of the first intermediate stud, as well as subsequent intermediate studs. Thus, the left side edge 62 of the first stud marking guide 60 is employed to draw stud position indicating line 310, and the right side edge 64 of the first stud marking guide 60 is employed as guide for drawing stud position indicating line 314. The left side edge 68 of the second stud marking guide 66 is employed as a guide for drawing stud position indicating line 318, and the right side edge 70 of the second stud marking guide 66 is employed as a guide for drawing stud position indicating line 322. Finally, the left side edge 74 of the third stud marking guide 72 is employed as a guide for drawing stud position indicating line 326, and the right side edge 76 of the third stud marking guide 72 is employed as a guide for drawing stud position indicating line 330. Stud positions are thus marked on the plate 300 for 16-inch center-to-center spacing.

Figure 14:
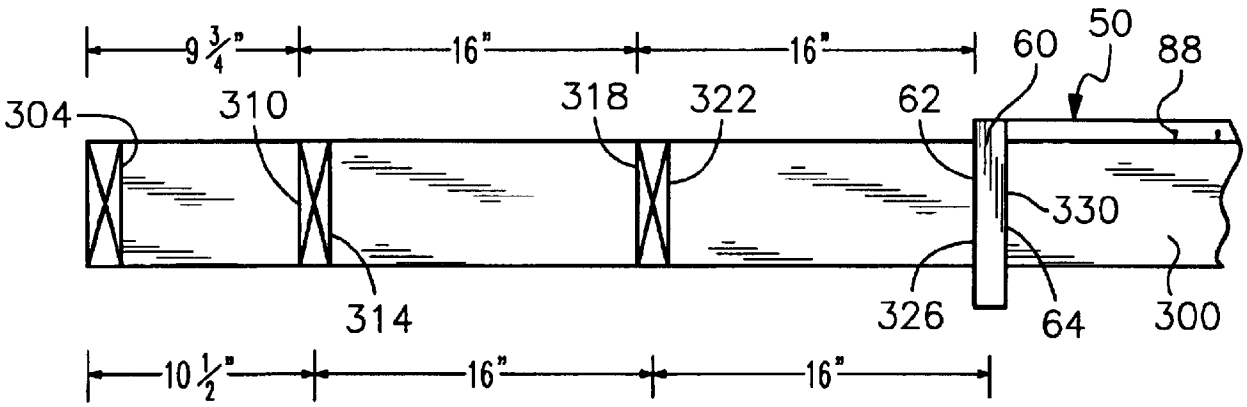
FIG. 14 depicts a still further subsequent step during use.

Referring next to FIG. 14, the layout tool 50 is advanced further to the right, and "X" marks are drawn between the stud position indicating lines 310, 314 and 318, 322 to represent the positions of studs. Although not visible in FIG. 14, "X" markings may also be drawn at this stage between the stud position indicating lines 326, 320.

In any event, as represented in FIG. 14, the process continues in the same manner as described above with reference to FIG. 13, along the entire lengths of the plate 300, marking the locations of studs on 16-inch center-to-center spacing.

Figure 15:
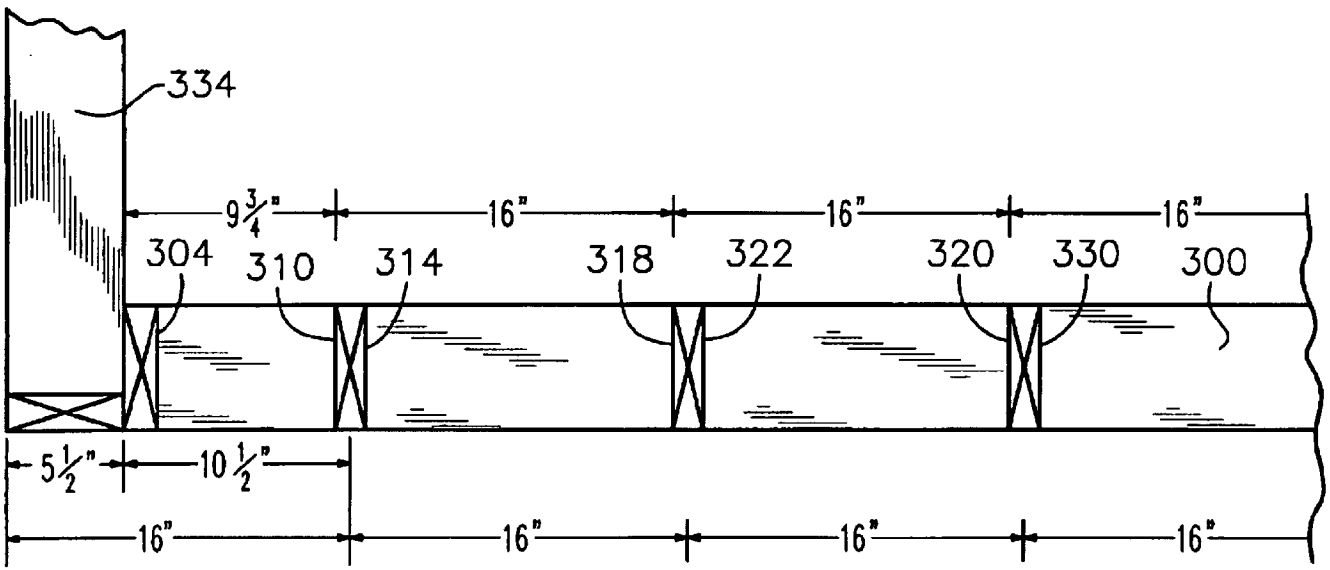
FIG. 15 depicts the final result with the top or bottom plate marked to show stud locations.

FIG. 15 represents the result, and also includes a plate 334 of an adjacent wall against which the wall being laid out is butted. The plate 334 is made of 2×6 inch lumber, and thus has a nominal thickness of 5½ inches. Positions are marked for studs on a 16-inch center-to-center spacing, but with the first intermediate stud spaced 9¾ inches from the end so that the edge of standard 4×8 toot sheathing material falls on the centerline of a stud.

In view of the symmetrical nature of the layout tool 50, the process described hereinabove with reference to FIGS. 12–15 can begin from the right side of the plate 300, employing the opposite side second butted wall starter indication 90 as a guide for starting mark (not shown).

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A layout tool for laying out positions at a predetermined spacing for the attachment of studs having a nominal thickness to a length of dimensioned lumber comprising a plate, said layout tool comprising:

an elongated rail for placement against the plate;

a first stud marking guide extending perpendicularly from said elongated rail, said first stud marking guide having left and right side edges and a width between said side edges corresponding to the nominal thickness of the studs;

a second stud marking guide extending perpendicularly from said elongated rail, said second stud marking guide likewise having left and right side edges and a width between said side edges corresponding to the nominal thickness of the studs, the left side edge of said second stud marking guide being spaced from the left side edge of said first stud marking guide a distance equal to the predetermined stud spacing; and a primary starter marking indication on said elongated rail intermediate said first and second stud marking guides and spaced from said second stud marking guide a distance equal to one-half the nominal thickness of the studs, said primary starter marking indication not being part of a series of uniformly spaced marks.

2. The layout tool of claim 1, which further comprises a third stud marking guide extending perpendicularly from said elongated rail, said third stud marking guide likewise having left and right side edges and a width between said side edges corresponding to the nominal thickness of the studs, the left side edge of said third stud marking guide being spaced from the left side edge of said second stud marking guide a distance equal to the predetermined stud spacing.

3. The layout tool of claim 2, which is symmetrical about a longitudinal midplane perpendicular to a longitudinal axis, and which further comprises an opposite-side primary starter marking indication on said elongated rail intermediate said second and third stud marking guides and spaced from said second stud marking guide a distance equal to one-half the nominal thickness of the studs, said opposite-side primary starter marking indication not being part of a series of uniformly spaced marks.

4. The layout tool of claim 3, wherein said opposite-side primary starter marking indication comprises a pencil guide groove having an elongated "V" configuration tapering in width to its narrowest width at an edge of said elongated rail.

5. The layout tool of claim 1, wherein said elongated rail is "L"-shaped in cross section and includes two legs at right angles, an outside surface of one of said legs engaging a surface of the plate to ensure proper orientation for perpendicular marking.

6. The layout tool of claim 1, which further comprises a butted wall starter marking indication on said elongated rail intermediate said first stud marking guide and said primary starter marking indication, said butted wall starter marking indication being spaced from said second stud marking guide a distance equal to one-half the nominal thickness of the studs plus the thickness of an adjacent wall to be butted, said butted wall starter marking indication not being part of a series of uniformly spaced marks.

7. The layout tool of claim 6, which further comprises a third stud marking guide extending perpendicularly from said elongated rail, said third stud marking guide likewise having left and right side edges and a width between said side edges corresponding to the nominal thickness of the studs, the left side edge of said third stud marking guide being spaced from the left side edge of said second stud marking guide a distance equal to the predetermined stud spacing.

8. The layout tool of claim 7, which is symmetrical about a longitudinal midplane perpendicular to a longitudinal axis, and which further comprises:

an opposite side primary starter marking indication on said elongated rail intermediate said second and third stud marking guides and spaced from said second stud marking guide a distance equal to one-half the nominal thickness of the studs, said opposite side starter marking indication not being part of a series of uniformly spaced marks; and an opposite side butted wall starter marking indication on said elongated rail intermediate said third stud marking guide and said opposite side primary starter marking indication, said opposite side butted wall starter marking indication being spaced from said second stud marking guide a distance equal to one-half the nominal thickness of the studs plus the thickness of an adjacent wall to be butted, said opposite side butted wall starter marking indication not being part of a series of uniformly spaced marks.

9. The layout tool of claim 8, wherein said primary starter marking indication and said butted wall starter marking indication each comprise a pencil guide groove having an elongated "V" configuration tapering in width to its narrowest width at an edge of said elongated rail.

10. The layout tool of claim 6, wherein said butted wall starter marking indication comprises a pencil guide groove having an elongated "V" configuration tapering in width to its narrowest width at an edge of said elongated rail.

11. The layout tool of claim 1, wherein said primary starter marking indication comprises a pencil guide groove having an elongated "V" configuration tapering in width to its narrowest width at an edge of said elongated rail.

* * * * *